United States Patent [19]

Marais

[11] 4,194,567

[45] Mar. 25, 1980

[54] METHOD AND APPARATUS FOR BALANCING PRESSURES IN AN OIL WELL

[75] Inventor: Lionel R. Marais, Paris, France

[73] Assignee: Compagnie Francaise des Petroles, Paris, France

[21] Appl. No.: 954,806

[22] Filed: Oct. 26, 1978

[30] Foreign Application Priority Data

Oct. 27, 1977 [FR] France ..... 77 32447

[51] Int. Cl.[2] ..... E21B 21/00; E21B 41/00

[52] U.S. Cl. ..... 166/311; 166/162; 175/71; 175/205

[58] Field of Search ..... 175/65, 69, 70, 71, 175/205; 166/311, 105.1–105.5, 107, 162

[56] References Cited

U.S. PATENT DOCUMENTS

| | | | |
|---|---|---|---|
| 1,867,832 | 7/1932 | Hill | 175/69 |
| 1,933,595 | 11/1933 | Kapp | 166/105.2 |
| 2,801,079 | 7/1957 | Gress | 166/162 X |
| 2,969,839 | 1/1961 | Greene | 166/162 X |
| 3,534,822 | 10/1970 | Campbell et al. | 175/69 |
| 3,566,980 | 3/1971 | Scroggins | 175/65 |
| 4,111,262 | 9/1978 | Duncan | 166/162 X |

FOREIGN PATENT DOCUMENTS

| | | | |
|---|---|---|---|
| 1218376 | 8/1966 | Fed. Rep. of Germany | 175/69 |
| 208604 | 3/1968 | U.S.S.R. | 175/69 |

*Primary Examiner*—Stephen J. Novosad

*Attorney, Agent, or Firm*—Sughrue, Rothwell, Mion, Zinn and Macpeak

[57] ABSTRACT

The invention relates to the balancing of the pressures in drilled strata, the pressures being lower than that of the liquid columns contained in the entire well.

The hydrostatic level of fluid, e.g. a liquid, in the bottom of the well is selected to obtain the balance and the fluid is caused to flow, to additionally serve as a drilling fluid, by separating the fluid into two columns, communicating at either end, between the tubing of the well and a set of rods therein and within the set of rods, and injecting a fluid of lower density into the upper part of one of the columns.

18 Claims, 4 Drawing Figures

METHOD AND APPARATUS FOR BALANCING PRESSURES IN AN OIL WELL

The invention relates to a method of balancing pressures in drilled strata when the pressures are too small to be compensated by a column of liquid in the drilling well, owing to the insufficiently low density of conventional low density liquids or to disadvantages of mixtures of very low densities.

In some cases, the pressure drop in the hydrocarbon regions occurring during production may result in a need for a fluid having a density as low as 0.5 gm/cm$^3$, the pressure being only 50 bars at a depth of 3000 meters. The density may even need to be lower. Fluids having almost zero density may also be needed when the regions worked have not yet been emptied of hydrocarbons, e.g. in mountaineous regions which have to be drilled down to valley level.

Since there is no suitable liquid having a density less than 0.75 gm/cm$^3$, low density gases are used, either as foam or as aerated mud.

Aerated mud has a serious disadvantage in that it is an unstable mixture having a density which cannot be known with sufficient accuracy to counterbalance the pressure in the stratum or to prevent an inrush occurring therein. In addition, the method requires the use of concentric rods inside the drilling rod and of great length, e.g. of the order of $\frac{7}{8}$ to $\frac{3}{4}$ of the depth of the well. This complicates the operations and increases their duration. In addition, the gas injected has to be very highly compressed and cleaned for re-use.

In the case where foam is used, a stable mixture can be obtained so that its density can be calculated in spite of variations along the column in dependence on temperature and pressure. However, owing to the great difference between the pressure during flow and the static pressure, a liquid has to be used to obtain the required back-pressure during various operations.

It is an object of the invention to obviate the disadvantages of the known methods by exerting the desired back-pressure by means of a flow of a first liquid having a given density at the bottom of the well, and a flow of a second driving fluid having a lower density at the top of the well, the second fluid driving the first fluid at the bottom of the well.

This method not only obviates the aforementioned disadvantages but can also give the desired back-pressure much more conveniently, irrespective of the nature of the fluids used.

The invention also relates to a method of balancing pressures by a double flow, the driving fluid being a gas and the fluid at the bottom of the well being a liquid and serving as the drilling liquid, its upper level being selected so that the hydrostatic pressure which it exerts on strata of ground adjacent the well is slightly above the pressure of the fluids in these strata.

Consequently, in contrast to the methods using foam, it is no longer necessary to compensate the pressures if the flow stops.

The invention also relates to a method of driving the first fluid at the bottom of the well by producing a pressure difference at the top of the fluid by means of a pipe system for a fluid of lower density, opening below the surface of the first fluid. This avoids the use of very long inner tubes as used in the aerated-mud method.

The space where the first fluid is driven by the second fluid, may be used as a place for separating waste entrained by the first fluid, the accumulated waste being raised at the same time as the drilling rods. Some of the light waste may be entrained by the second fluid.

Further features of the invention will become apparent from the following description of embodiments thereof, given by way of example only, with reference to the accompanying drawings.

Figure 1:
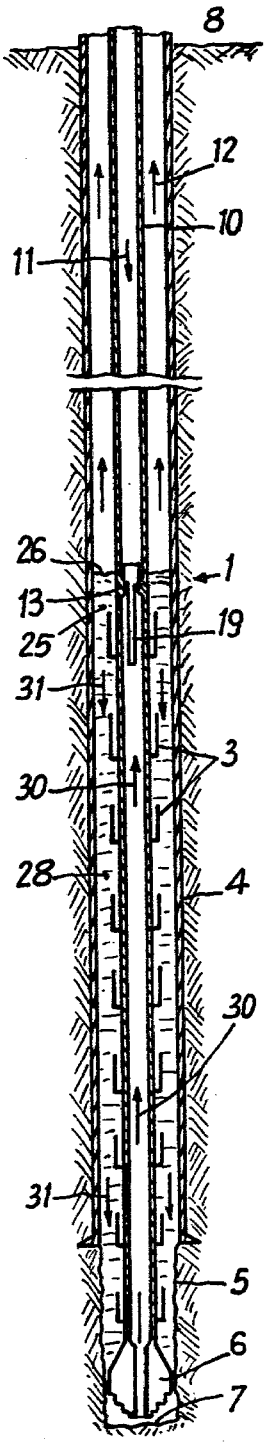
FIG. 1 is a general diagrammatic view of a well, the scale in the axial direction being much smaller than in the direction perpendicular thereto, so as to illustrate the relative lengths of components of an embodiment of apparatus for carrying out an embodiment of the method according to the invention.
Figure 2:
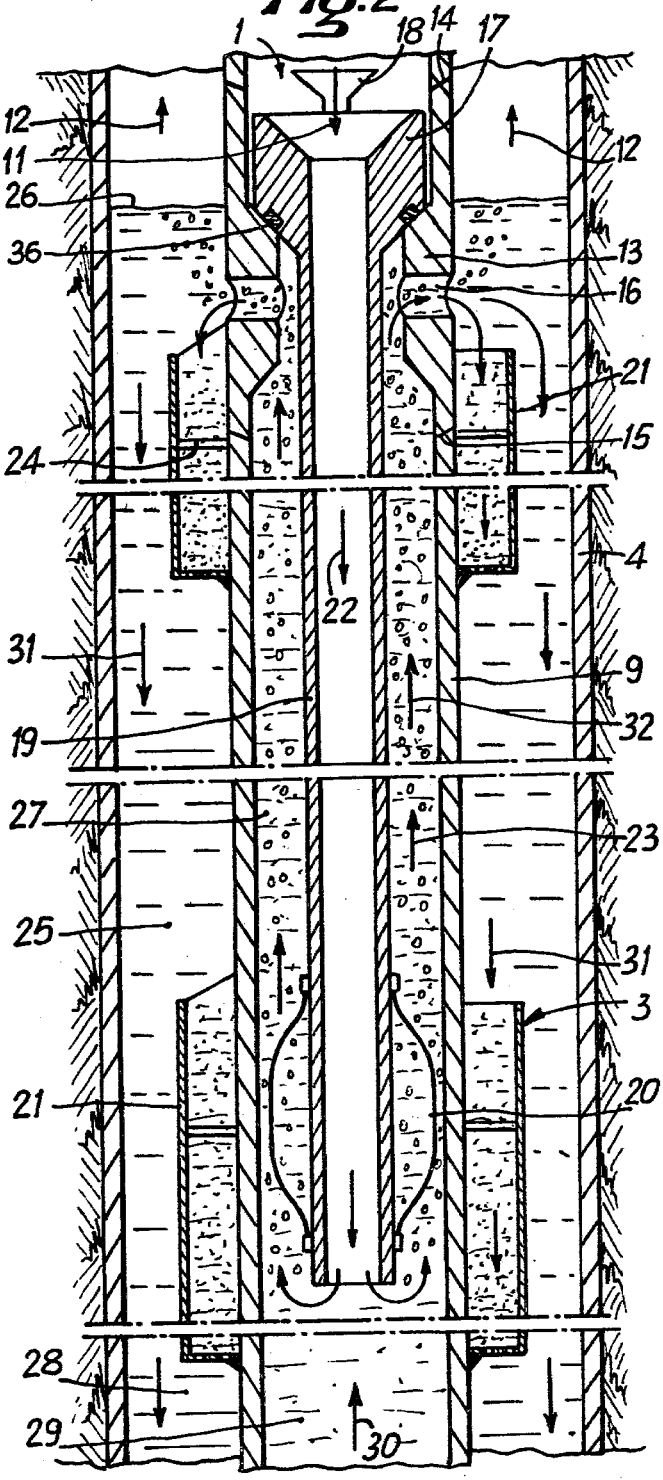
FIG. 2 is a diagrammatic section of part of the well of FIG. 1 where the flows of the first and second fluids meet.

FIGS. 1 and 2 show an apparatus comprising an assembly 1 approximately half way between the bottom of a well 7 and the surface 8 and resting on a connector providing a seat 13. The assembly comprises an assembly of inner rods 19 having a length which is small (e.g. 100–200 m) compared with the depth of the well (e.g. 3000 m).

The connector 13, which is more clearly seen in FIG. 2, is screwed at 14 to the upper drilling rods 10 and at 15 to the lower drilling rods 9. Rods 9, on their outer periphery, bear settling trays 3 having walls 21 which are made of perforated or non-perforated sheet metal and comprise reinforcing ribs 24, depending on the wall dimensions. The trays can either be removable or welded to rods 9, in which case they may withstand any impacts and, if provided with reinforcing ribs, can also withstand crushing between the rods 9 and tubing 4 at the walls of the drilling hole 5. The dimensions of trays 3 depend on the number and quantity of waste substances which are to be raised.

Connector 13 comprises, in addition to the conical part or seat, wide orifices 16. Its inner diameter is sufficient for the inner tubes 19 and centering means 20 which may be associated therewith. The conical part receives a holder 17 of the inner tubes 19. The holder 19, which is provided with seals 36, bears against the conical part of connector 13 and can be lowered or raised by any suitable tools which are locked and unlocked by cable and are secured to the head of holder 17. The tools, which are well known, have not been shown.

Connector 13 is positioned in the set of drilling rods when lowered into the well, so that it is in the operating position, e.g. for drilling, boring, or scraping the walls of the hole at the level 26 of the liquid, where connector 13 is in contact with strata of ground and subjects them to a pressure slightly greater than that of the fluids in the strata.

Rods 19, holder 7 and centering means 20 can also be placed in position when the connector 13 is still at the surface.

In the case where the liquid at the bottom of the well is water and is present in excess and filis the well, it can be brought to the desired level by pumping gas under pressure, either at the same time as connector 13 is lowered or in a single operation when the connector has reached the desired level.

When the water reaches the desired level 26, the top flow of gas is switched on, so as to cause the liquid to flow.

To this end, gas is introduced into the set of rods 10, where it flows in the direction of arrow 11, and 22 into the inner tubes 19, and drives back the liquid therein to the lower end of the tubes. The gas then rises from the lower end of the tubes into the annular space 27 between rods 19 and 9 in the direction of arrow 23.

In this region, the replacement of liquid by gas produces a pressure difference between the fluid inside rods 9 and the fluid at the same level outside rods 9. This creates a substantial pressure difference of the order of 10 bars between the level of liquid inside rods 9 at the bottom of tubes 19 and the level 26 of liquid outside rods 9, along tubes 19 for a distance of the order of 100 m.

This results in a flow of liquid in region 29 of rods 9 and in the direction of arrow 30 which raises waste which is conveyed by the flow of gas travelling from the lower end of rods 19 into the annular space 27. Consequently liquid charged with waste, rises in the direction of arrow 30 and with the gas at 32 and leaves through orifices 16.

A small proportion of liquid is carried in the form of a mist by the gas escaping at 12 above the level 26 of the liquid and thus rises to the surface. Most of the water falls with the waste into the annular space 28 as indicated by arrow 31, the liquid leaving the waste in the settling trays 3. Since the annular space 28 has a greater cross-section than the interior space 29 in rods 9, the waste is raised more rapidly than the liquid returns into space 28, thus helping to improve the cleaning of the liquid travelling through trays 3 during its return to the drilling tool 6.

When the drilling tools are replaced, the settling trays 3 are raised with the set of rods. The trays can also be secured to removable holders, which are raised when required without moving the set of rods 9.

The hydrostatic level 26 can be monitored by echo sounders or by any other method and maintained at a suitable level, if required by injecting liquid from the surface into rods 10 or into the annular space between tubing 4 and rods 20.

Figure 3:
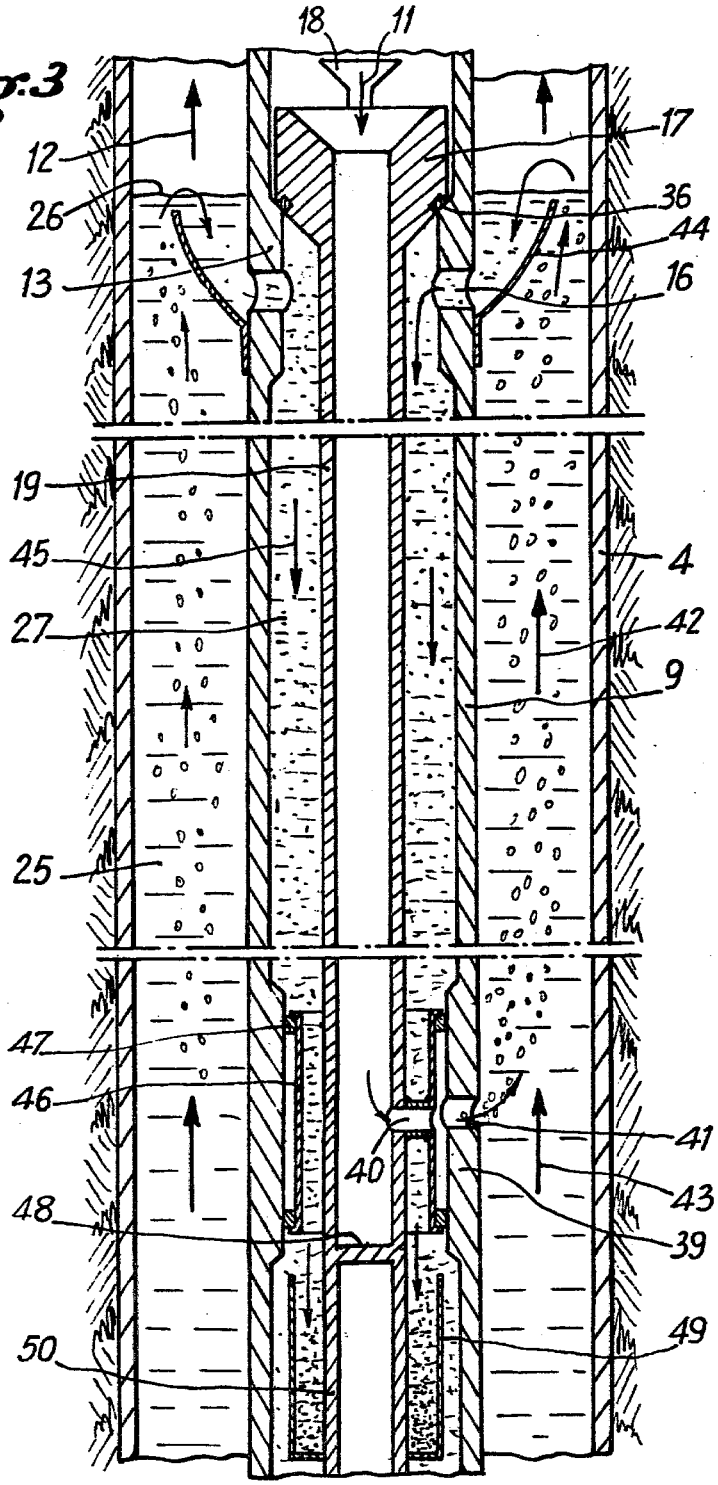
FIG. 3 is a diagrammatic section similar to that of FIG. 2 showing another embodiment according to the invention.

FIG. 3 shows part of another embodiment of the apparatus similar to that shown in FIG. 2. For simplicity, the centering means 20 have been omitted from the drawing.

In the embodiment in FIG. 3, the lower end 48 of tube 19 is closed at its base and has a lateral orifice 40 opening on to an orifice 41 in the tube 9. In order to ensure that orifices 40 and 41 coincide, orifice 40 terminates in cylindrical flanges 46, the ends of which have seals 47 bearing on the inner surface of a thickened portion 39 of tube 9 through which orifice 41 extends. Trays 49 are then disposed at 50 below the closure means 48 of tube 19, which is then prolonged downwards to near the drilling tool and inside tubes 9. They can thus easily be re-assembled when tubes 19 are withdrawn, without it being necessary to re-assembly tubes 9.

As in the preceding case, gas 11 is injected into tube 19 but instead of rising in the annular space 27 it flows in the direction of arrow 42. Owing to the pressure difference between the liquid in space 27 and the liquid at the same level but mixed with gas in space 25, the liquid rises in space 25 in the direction of arrow 42 up to level 26, travelling round a baffle 44. The gas escapes at 12, whereas the liquid charged with waste flows through orifices 16 into the annular space 27 in the direction of arrow 45. The waste is retained by the settling trays, which can be distributed in any desired manner.

Figure 4:
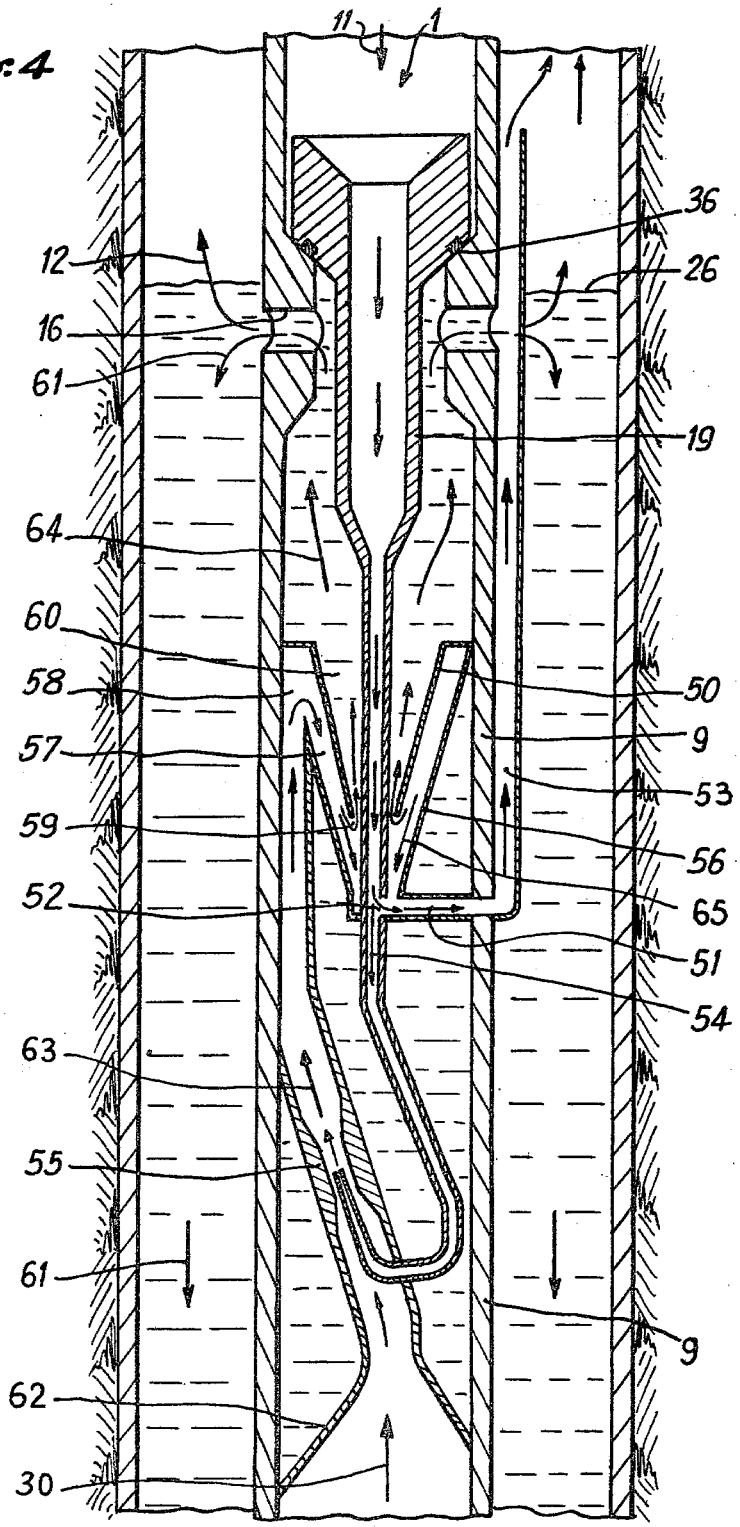
FIG. 4 is a diagrammatic section similar to that of FIG. 3 showing a further embodiment according to the invention.

The method has been described with reference to two embodiments wherein the upper or driving flow is by means of a gas and the bottom flow is by means of a liquid. Of course, the liquids used can be two foams or two liquids having different densities, or a foam and a liquid. In addition, the means for driving the lower flow can be replaced by equivalent means such as a venturi tube 55 (FIG. 4) which, in the case of the reverse flow in FIG. 2, is disposed inside the set of rods 9, the smallest cross-section of the venturi tube 55 being disposed at a level sufficiently below orifices 16, so that the part of the gas 11 flowing in the direction of arrow 54 and coming from the surface and then from tube 19 leaves the venturi 55 in an upward direction. The negative pressure produced by venturi 55 drives the liquid 30 coming from the well and charged with waste, which is directed to venturi 55 by means of wall 62. The mixture 63 at the venturi outlet travels at 58 into a cyclone bonded by a bottom cone 56 and a top cone 50. The light part of mixture 63, freed from waste, rises at 64 through orifice 59 in cone 50 into the annular space 60 between tubes 19 and 9. It then escapes through orifices 16 and is there separated, the gas rising at 12 and the liquid re-descending at 61. The heavy part 65 charged with waste escapes from the orifice of cone 56 and mixes at 52 with a part of gas 11 and forms a mixture 51 which can be carried to the surface by a tube 53, which, if required, can extend up to the surface or open above the hydrostatic level 26.

1. A method balancing the low pressures of fluids in subsurface strata communicating with a well comprising the steps of:

(a) disposing at the bottom of said well a first fluid;

(b) maintaining the surface of said first fluid at a level below the ground corresponding to a hydrostatic pressure exerted by the fluid on the adjacent subsurface strata, said pressure being slightly above the pressure of the fluids in the strata;

(c) providing a set of rods within said well;

(d) driving said first fluid by a second fluid having a density lower than the density of the first fluid to thereby circulate said first fluid exclusively below said corresponding level, said circulation comprising an upward flow of said first and second fluids within a common region of said well.

2. A method as claimed in claim 1, wherein said first fluid is driven by producing a pressure difference at the same level between the columns of fluids in the annular space bounded by the well and in the interior of said rods at an orifice connecting said annular space to said interior of said rods, one of said columns being used for upward flow of said second fluid.

3. A method as claimed in claim 2, wherein said common region is an annular region in said interior of said rods.

4. A method as claimed in claim 2, wherein said common region is the annular space bounded by the well tubing.

5. A method as claimed in claim 2 or 3, wherein said first fluid is cleaned at the end of said upward flow in said common region.

6. A method as claimed in claim 5, wherein waste entrained by said first fluid is separated by cyclones, said waste being raised by said second fluid.

7. A method as claimed in claim 6, wherein cleaning is effected by sedimentation in settling trays disposed in said annular space.

8. A method as claimed in claim 6, wherein cleaning is effected by sedimentation in settling trays disposed in said interior of said rods.

9. A method as claimed in claim 1, wherein said first fluid is driven by producing a pressure difference by means of a venturi tube through which said second fluid flows in an upward direction so that said first fluid is sucked up to an orifice connecting said interior of said rods to said annular space.

10. An apparatus for balancing the low pressures of fluids in subsurface strata communicating with a well comprising:

(a) a well bore having tubing disposed at its interior surface;

(b) means for containing a first fluid at the bottom of said well, and for maintaining the surface of said first fluid at a level below the ground corresponding to a hydrostatic pressure exerted by the fluid on the adjacent surface strata, said pressure being slightly above the pressure of the fluid in the strata;

(c) a set of rod means disposed within said well providing a path for a second fluid having a density less than said first fluid;

(d) means for driving said first fluid by said second fluid;

(e) means for circulating said first fluid exclusively below said corresponding level under control of the second fluid;

(f) wherein said circulating means further provide an upward flow of said first and second fluids within a common region of said well.

11. The apparatus of claim 10, wherein said set of rods comprises at least one means for receiving a pipe system for supplying said second fluid thereto, and at least one orifice in a wall of said set of rods.

12. Apparatus as claimed in claim 11, wherein said means for receiving a pipe system comprises a seat comprising a conical part on the inner wall of said set of rods, said orifice being disposed below said seat, and wherein said rods have settling trays being secured to the outer surface of the wall of said rods.

13. Apparatus as claimed in claim 11, wherein settling trays are secured to the wall of said rods and below the lower end of said pipe system for supplying a low-density fluid.

14. Apparatus as claimed in claim 11, wherein said pipe system for supplying a low-density fluid is closed at its lower end, said pipe system being provided with an orifice near said lower end connecting said pipe system to the space surrounding said pipe system.

15. Apparatus as claimed in claim 14, comprising a baffle secured to the outer wall of said set of rods, immediately below said orifice in said rods which is disposed below said means for receiving said pipe system, said baffle extending upwardly and away from said rods to leaving a passage for said upward flow in the annular space surrounding said rods.

16. Apparatus as claimed in claim 14, wherein settling trays are carried on a holder secured to said pipe system.

17. Apparatus as claimed in claim 11, wherein said pipe systems for supplying a low-density fluid comprises a venturi tube having an outlet surmounted by a cyclone device having two outlets, one outlet of said cyclone device being connected to a lateral orifice in said rods and the other outlet of said cyclone device being connected to a pipe system for low-density fluid rising to the surface.

18. Apparatus as claimed in claim 11 wherein settling trays are secured to the outer surface of the wall of said rods.

* * * * *